US009435499B2

(12) United States Patent
Xu et al.

(10) Patent No.: US 9,435,499 B2
(45) Date of Patent: Sep. 6, 2016

(54) BAR-TYPED DOUBLE-ROW LED LIGHTING

(71) Applicant: Wanjiong Lin, Ningbo (CN)

(72) Inventors: Guojun Xu, Ningbo (CN); Huangfeng Pan, Ningbo (CN)

(73) Assignee: Self Electronics Co., Ltd., Ningbo (CN)

( * ) Notice: Subject to any disclaimer, the term of this patent is extended or adjusted under 35 U.S.C. 154(b) by 63 days.

(21) Appl. No.: 14/676,450

(22) Filed: Apr. 1, 2015

(65) Prior Publication Data

US 2015/0345719 A1 Dec. 3, 2015

(30) Foreign Application Priority Data

May 28, 2014 (CN) ..... 2014 1 0228583

(51) Int. Cl.

| | |
|---|---|
| ***F21V 1/00*** | (2006.01) |
| ***F21V 3/02*** | (2006.01) |
| ***F21V 13/02*** | (2006.01) |
| *F21W 131/40* | (2006.01) |
| *F21Y 101/02* | (2006.01) |
| *F21Y 103/00* | (2016.01) |
| *F21Y 113/00* | (2016.01) |

(52) U.S. Cl.
CPC .. *F21S 4/28* (2016.01); *F21V 3/02* (2013.01); *F21V 13/02* (2013.01); *F21W 2131/40* (2013.01); *F21Y 2101/02* (2013.01); *F21Y 2103/003* (2013.01); *F21Y 2113/00* (2013.01)

(58) Field of Classification Search
CPC ..... F21S 4/28; F21V 5/00; F21V 13/02; F21W 2131/40; F21Y 2101/02; F21Y 2103/003
USPC ..... 362/235
See application file for complete search history.

(56) References Cited

U.S. PATENT DOCUMENTS

| | | | | |
|---|---|---|---|---|
| 5,461,417 | A * | 10/1995 | White | G01N 21/8806 348/125 |
| 7,815,341 | B2 * | 10/2010 | Steedly | F21V 19/0055 362/217.01 |
| 7,918,591 | B2 * | 4/2011 | Lynch | F21V 19/0055 257/99 |
| 8,167,465 | B2 * | 5/2012 | Cha | F21V 15/01 315/185 R |
| 2013/0235576 | A1 * | 9/2013 | McGowan | F21V 7/00 362/235 |

* cited by examiner

*Primary Examiner* — Ali Alavi
(74) *Attorney, Agent, or Firm* — Wang Law Firm, Inc.

(57) ABSTRACT

A bar-typed double-row LED lighting includes an elongate shell, a first row LED lamp, a second row LED lamp, a first cover, and a second cover. Each of the LED chips of the first row LED lamp is staggered from that of the second row LED lamp. The first cover includes a plurality of first depressions. The second cover includes a plurality of second depressions. Since each of the LED chips of the first row LED lamp is staggered from that of the second row LED lamp and the first, second covers respectively include a plurality of first, second depressions which are configured for avoiding or preventing the first, second covers from stopping the travel of the light emitted from the second first row LED lamps. As a result, the bar-typed double-row LED lighting can extend effective illumination area and improve luminous efficiency thereof.

10 Claims, 3 Drawing Sheets

BAR-TYPED DOUBLE-ROW LED LIGHTING

RELATED APPLICATION

The present application claims the benefit of priority to the Chinese Application, CN201410228583.3, filed on May 28, 2014, the entire specification of which is incorporated herein by reference.

BACKGROUND

1. Technical Field

The present application relates to lighting devices, and more particularly to a bar-typed double-row LED lighting.

2. Description of the Related Art

For years, people have used traditional incandescent or fluorescence lighting apparatus in order to address their interior lighting concerns. However, such lighting apparatuses present a number of drawbacks. For example, the popular halogen apparatus presents the following drawbacks, such as relatively high power consumption, inefficiency of light dispersion due to the placement of its metal shield in the line sight of the halogen bulb, and its limited effectiveness in preventing glare from the halogen bulb.

Recently, a number of LED lighting apparatuses have been designed to replace the halogen apparatus, as well as other traditional incandescent or fluorescence lighting apparatuses. Especially, the LED lighting apparatuses are used in the super market, exhibition hall, museum, and so on because of long-life and energy-saving thereof. In some special situation, such as freezer, storage racks, exhibition cabin, etc. double-row LED lightings are adopted as the double-row LED lamp has bigger range of illumination than traditional single-row LED lighting. However, because of drawbacks of structure design or LED chip arrangement, the light emitted from one row LED lamp of double-row LED lighting is blocked by another row LED lamp, vice versa. As a result, the range of illumination of the LED lighting is reduced although it is bigger than that of single-row LED lighting. Moreover, shadow may be formed in the sides of the double-row LED lighting.

The above information disclosed in this section is only for enhancement of understanding of the background of the invention and therefore it may contain information that does not form the prior art that is already known in this country to a person of ordinary skill in the art.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout three views.

DETAILED DESCRIPTION

The present invention is illustrated by way of example and not by way of limitation in the figures of the accompanying drawings. It should be noted that references to "an" or "one" embodiment in this disclosure are not necessarily to the same embodiment, and such references mean at least one.

Figure 1:
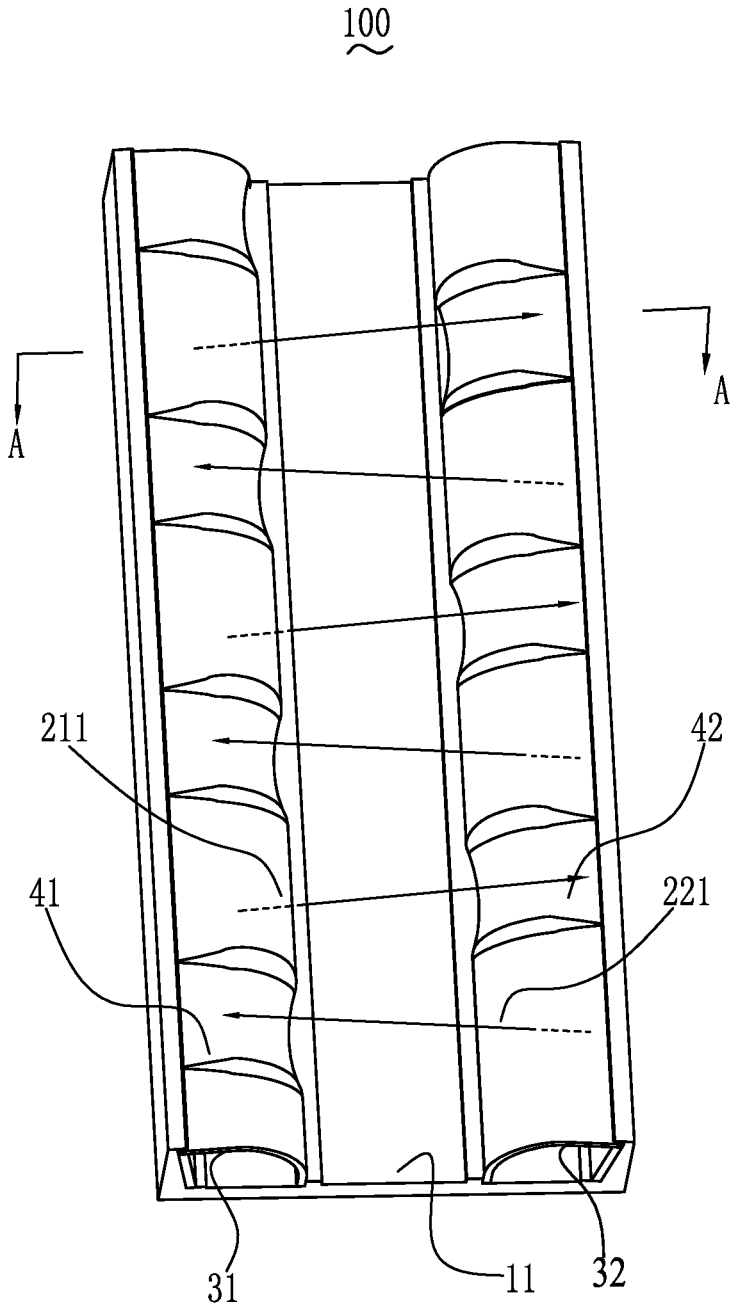
FIG. 1 is an isometric view of a bar-typed double-row LED lighting in accordance with one embodiment of the disclosure.
Figure 2:
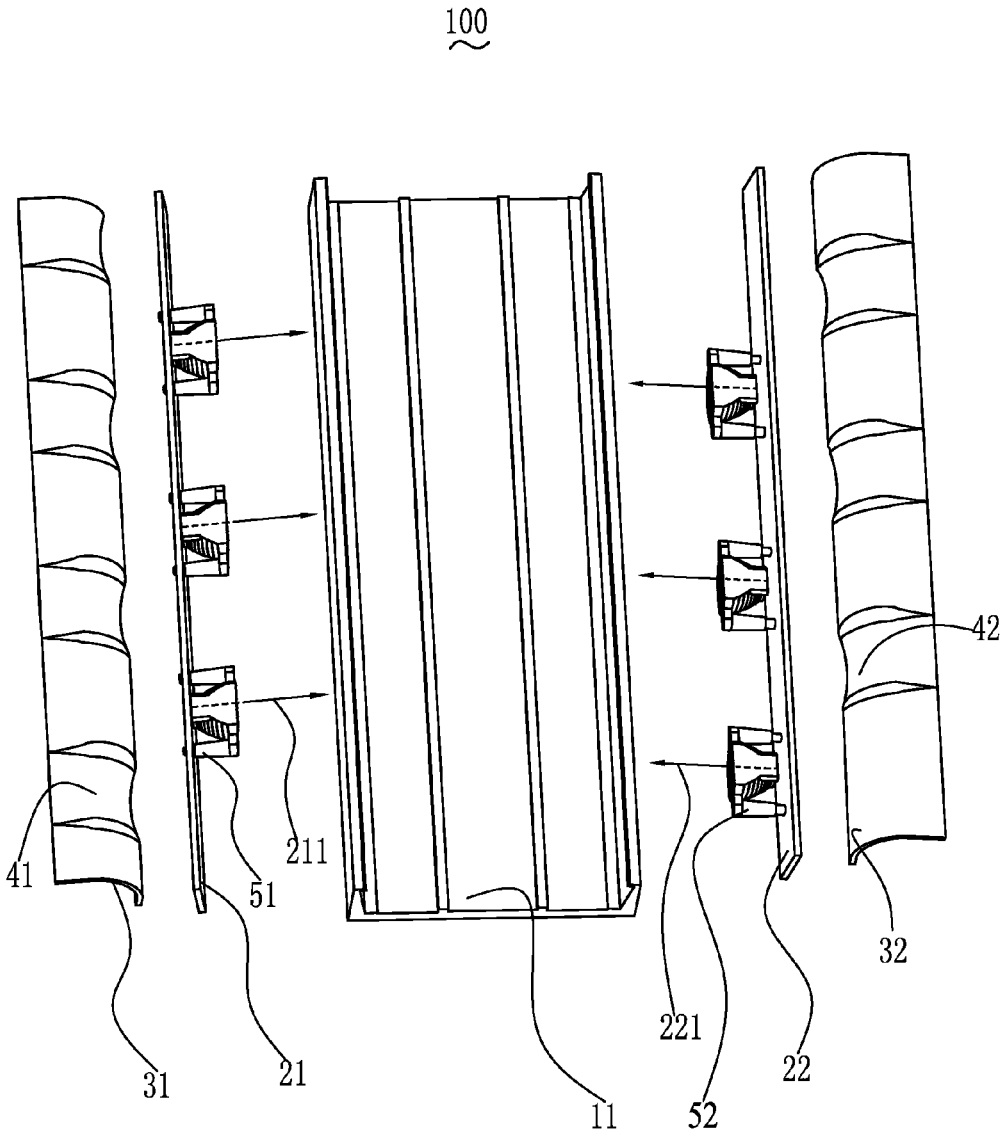
FIG. 2 is an isometric and explored view of the bar-type double-row LED lighting of FIG. 1.

Referring to FIG. 1 to FIG. 2, a bar-typed double-row LED lighting 100 according to the present invention is shown. The bar-typed double-row LED lighting 100 includes an elongate shell 11, a first row LED lamp 21 disposed on the elongate shell 11, a second row LED lamp 22 disposed on the elongate shell 11 and spaced from and parallel to the first row LED lamp 21, a first cover 31 coupled onto the first row LED lamp 21, and a second cover 31 coupled onto the second row LED lamp 22. Understandably, the bar-typed double-row LED lighting 100 further includes other functional components, such as power, controlling devices, and so on, which is well known for a person skilled in the art.

The first, second LED lamps 21, 22 respectively have one or a plurality of LED chips. And the first, second LED lamps 21, 22 have same number of the LED chips. Each of a plurality of LED chips functions as one independent light source and has an optical axis. Therefore, the first, second LED lamps 21, 22 have same optical axes with the LED chips thereof. For avoiding duplication and simply describing, only two adjacent first, second optical axes 211, 221, which respectively belong to the first, second LED lamps 21, 22, are shown and labeled in figures and description. The first, second covers 31, 32 respectively have one and same number of depressions which are formed respectively on the first, second covers 31, 32. For simply describing, only serial numbers 41 and 42 are used to indicate a first depression which corresponds to the second optical axis 221 and a second depression which corresponds to the first optical axis 211. Similarly, the following first, second row lenses 51, 52 include a plurality of lenses which have same number of the LED chips of the first, second row LED lamps 21, 22.

Referring to FIG. 1 and FIG. 2, the elongate shell 11 is configured for carrying the whole lighting device. The elongate shell 11 may be made of metal, plastic, alloy, and so on and has certain configuration for assembling the first, second LED lamps 21, 22. The elongate shell 11 may be an elongate groove or an elongate plate as long as to satisfy the requirement of assembling the first, second LED lamps 21, 22. As is well known for a person skilled in the art, the parameters of the elongate shell 11, such as length, width, and so on, are prior art, and need not to described in detail.

Referring to FIG. 1 and FIG. 2, the first LED lamp 21 is assembled onto the elongate shell 11. As is well known, the first LED lamp 21 includes a plurality of LED (Lighting Emitting Diode, LED) chips, and a circuit board (not labeled). The pluralities of LED chips are mounted onto the circuit board along the length of the elongate shell 11 and are spared from each other.

Figure 3:
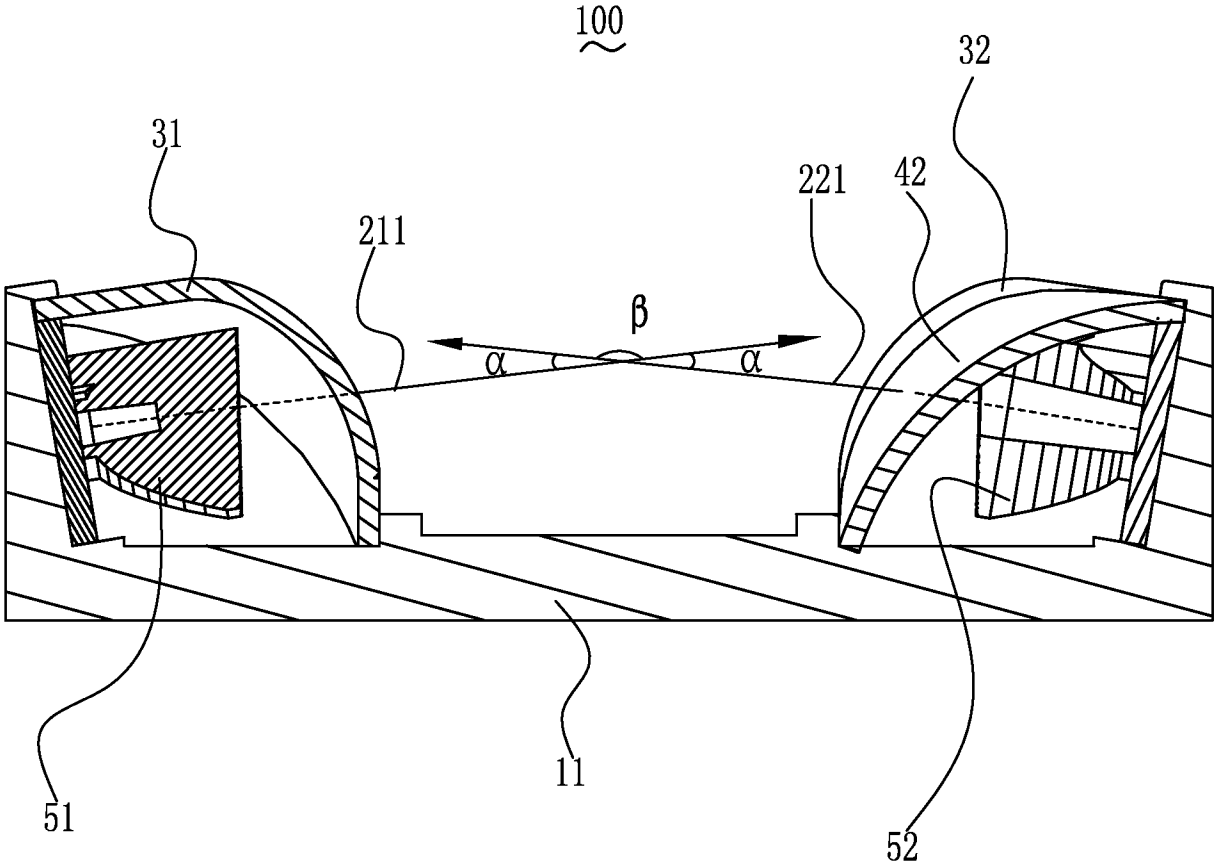
FIG. 3 is a cross sectional view of the bar-typed double-row LED lighting of FIG. 1 taken along lines A-A of FIG. 1.

The second row LED lamp 22 is assembled onto the elongate shell 11 and is spaced from and parallel to the first row LED lamp 21. The second row LED lamp 22 includes a plurality of LED chips and a circuit board (not label). The pluralities of LED chips are mounted onto the circuit board along the length of the elongate shell 11 and are spaced from each other. Each of the LED chips of the first row LED lamp 21 is staggered from that of the second row LED lamp 22. That is to say, in an arbitrary cross section along a direction vertical to the length of the elongate shell 11, the LED chips of the second row LED lamp 22 is not in the same cross section with that of the first row LED lamp 21. Referring to FIG. 3 together, for further describing the relationship of the LED chips of the first, second row LED lamps 21, 22, the optical axes of the LED chips can be introduced. As is well known, each of the LED chips of the first, second row LED lamps 21, 22 has one optical axis. Since each of the LED chips of the first row LED lamp 21 is staggered from that of the second row LED lamp 22, the first optical axes 211 of the LED chips of the first row LED lamp 21 do not intersect with that of the second row LED lamp 21. However, when the first, second optical axes 211, 221 of the LED chips of the first, second row LED lamp 21, 22 are projected onto a cross section of the elongate shell 11 along a direction vertical to a longitudinal direction thereof, the first optical axis 211 of the LED chips of the first row LED lamp 21 have a crossing point with that of the LED chips of the second row LED lamp 22. Therefore, an angle β between the first optical axis 211 of the LED chips of the first row LED lamp 21 and that of the second row LED lamp 22 is formed when the first, second optical axes 211, 221 of the LED chips of the first, second row LED lamp 21, 22 are projected onto the cross section of the elongate shell. The angle β varies from 10 degrees to 80 degrees. In the present embodiment, the angle β is 83 degrees. Referring to FIG. 3 together, it is need to further explain that when the angle β is less than 10 degrees the following first, second depressions 41, 42 fail to eliminate shadow because no matter how much an arc highness of the first, second depressions 41, 42 is the first, second cover 31, 32 will stop light. And when the angle β is greater than 80 degrees, it is no need to form the first, second depressions 41, 42 on the first, second cover 31, 32 respectively as the first, second cover 31, 32 can never stop light emitted from the second, first row LED lamp 22, 21. The first, second row LED lamps 21, 22 are arranged on the elongate shell 11 along the length thereof so as to the first row LED lamp 21 is parallel to the second row LED lamp 22. The second row LED lamp 22 does not contact with the first row LED lamp 21 along a direction vertical to the length of the elongate shell 11. That is to say, the second row LED lamp 22 is spaced from the first row LED lamp 21.

As shown in FIG. 2, the bar-typed double-row LED lighting 100 further includes a first row lens 51. The first row lens 51 includes a plurality of lenses and is arranged into lighting direction of the first row LED lamp 21. The first row lens 51 have same number of the lenses with the LED chips of the first row LED lamp 21 so as to match with each of the LED chips for light distribution. The LED chips of the first row LED lamp 21 have same parameters, for example, shape, specification, etc. and the lenses of the first row lens 51 have same parameters, for example, shape, specification, and so on. A distance between any two adjacent lenses of the first row lens 51 is equal to that between any two adjacent lenses of the following second row lens 52 so as to achieve uniform illumination. Since each of the LED chips of the first row LED lamp 21 is staggered from that of the second row LED lamp 22, the pluralities of lenses of the first row lens 51 are staggered from that of the second row lens 52. A minimum distance between any two adjacent lenses of the first row lens 51 is equal to a maximum diameter of a light emitting surface of a lens of the second row lens 52. Therefore, by designing the light distribution of the first, second row lens 51, 52, the light emitted from the LED chips of the first, second LED lamps 21, 22 can travel through the space between two adjacent lenses so as to eliminate shadow and improve light effect.

The second row lens 52 includes a plurality of lenses and a minimum distance between any two adjacent lenses of the second row lens 52 is equal to a maximum diameter of a light emitting surface of a lens of the second row lens 51. For ease to design and manufacture, a distance between any two adjacent lenses of the first row lens 51 is equal to that of the second row lens 52. The second row lens 52 has same configuration and work principle with the first row lens 51. Therefore, the second row lens 52 needs not to be described in detail.

The first cover 31 may be made of transparent or semi-transparent material and is mounted on the elongate shell 11. The first cover 31 has an arc-shaped configuration and forms a cavity with the elongate shell 11 for receiving the first row LED lamp 21 and the first row lens 51. In assembly, the first row LED lamp 21 should be mounted onto the elongate shell 11 at first. And secondly, the first row lens 51 is arranged on the lighting direction of the first row LED lamp 21 and fixed on the circuit board thereof. Finally, the first cover 31 is disposed on the elongate shell 11 and covers the first row LED lamp 21 and the first lens 51. The first cover 31 includes a plurality of first depressions 41 which are formed thereon and far away from the second optical axis 221 of one LED chip of the second row LED lamp 22. As is well known, the optical axis is a center line of light emitted from a light source, and when a beam of light rotates around the optical axis, the characteristic of the light would have no any change. The first depression 41 is configured for avoiding or preventing the first cover 31 from stopping the travel of the light emitted from the second row LED lamp 22. That is to say, the first depression 41 may has an arbitrary shape as long as it may not stop the travel of the light emitted from the second row LED lamp 22. Therefore, the first depression 41 may have a cone-shaped groove or a circular arc-shaped groove. The first depression 41 may be formed into the cone-shaped groove which rotates in a radius around the second optical axis 221. The light from one LED chip of the second row LED lamp 22 is limited in a cone-shaped light beam which has no interference with the cone-shaped configuration of the first depression 41. In result, the first depression 41 can eliminate shadow and improve light effect of the second row LED lamp 22. For another, the first depression 41 may be the circular arc-shaped groove which is formed in a radius around the second optical axis 221 of the second row LED lamp 22. Comparing the cone-shaped groove, it is ease to manufacture the circular arc-shaped groove. Understandably, the circular arc-shaped groove has same functions and work principle with the cone-shaped groove. Therefore, in the present embodiment, the first depression 41 is the circular arc-shaped groove. Referring to FIG. 3 together, when the spacing distance between the first row LED lamp 21 and the second row LED lamp 22 reduces, the distance between the first, second cover 41, 42 will reduce and the first, second optical axes 211, 221 will further get close to the second, first cover 42, 41 respectively. In a result, the first depression 41 must have greater arc highness. Therefore, the arc highness of the circular arc-shaped groove of the first depression 41 increases with decrease of the spacing distance between the first row LED lamp 21 and the second row LED lamp 22, vice versa. On the other hand, when the angle β between the first, second optical axes 211, 221 of the LED chips of the first row LED lamp 21 and that of the second row LED lamp 22 reduces, the first, second optical axes 211, 221 will far away from the second, first cover 42, 41 respectively. In a result, the first depression 41 can have less arc highness. Therefore, the arc highness of the circular arc-shaped groove of the first depression 41 increases with increase of the angle between the first, second optical axes 211, 221 of the LED chips of the first row LED lamp and that of the second row LED lamp along the light direction of the bar-typed double-row LED lighting 100, vice versa.

The second cover 32 may be made of transparent or semitransparent material and is mounted on the elongate shell 11 and has a plurality of second depressions 42 formed thereon. The second cover 32 and the second depressions 42 have same configuration and work principle with the first cover 31 and the first depression 41. Therefore, the second row lens 52 needs not to be described in detail. Need to further explain that an arc highness of the circular arc-shaped groove of the second depressions 42 increases with increase of the angle between the first, second optical axes 211, 221 of the LED chips of the first, second row LED lamps 21, 22 along the lighting direction of the bar-typed double-row LED lighting 100 when the second depression 42 is the circular arc-shaped groove.

In use, since each of the LED chips of the first row LED lamp 21 is staggered from that of the second row LED lamp 22 and the first, second covers 31, 32 respectively include a plurality of first, second depressions 41, 42 which are configured for avoiding or preventing the first, second covers 31, 32 from stopping the travel of the light emitted from the second first row LED lamps 22, 21. As a result, the bar-typed double-row LED lighting 100 can extend effective illumination area and improve luminous efficiency thereof. Moreover, as each of the LED chips of the first row LED lamp 21 is staggered from that of that of the second row LED lamp 22, and the first optical axis 211 of the LED chips of the first row LED lamp 21 have a crossing point with that of the LED chips of the second row LED lamp 22 when the first, second optical axes 211, 221 of the LED chips of the first, second row LED lamps 21, 22 are projected onto a cross section of the elongate shell along a direction vertical to the longitudinal direction thereof, the bar-typed double-row LED lighting 100 can achieve a compact structure and uniform illumination effect, and further improve its performance.

While the present invention has been described by way of example and in terms of exemplary embodiment, it is to be understood that the disclosure is not limited thereto. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A bar-typed double-row LED lighting comprising an elongate shell, a first row LED lamp disposed on the elongate shell, a second row LED lamp disposed on the elongate shell and spaced from and parallel to the first row LED lamp, each of the first, second row LED lamps comprising a plurality of LED chips, the LED chips of each of the first, second row LED lamps are spaced from each other, each of the LED chips of the first row LED lamp being staggered from that of the second row LED lamp, a first optical axis of the LED chips of the first row LED lamp having a crossing point with a second optical axis of the LED chips of the second row LED lamp when the first, second optical axes of the LED chips of the first, second row LED lamps are projected onto a cross section of the elongate shell along a direction vertical to a longitudinal direction thereof, the bar-typed double-row LED lighting further comprising a first cover coupling onto the first row LED lamp, and a second cover coupling onto the second row LED lamp, the first cover comprising a plurality of first depressions which are formed far away from the second optical axis of one LED chip of the second row LED lamp, the second cover comprising a plurality of second depressions which are formed far away from the first optical axis of one LED chip of the first row LED lamp.

2. The bar-typed double-row LED lighting of claim 1, wherein the angle between the first optical axis of the LED chips of the first row LED lamp and the second optical axis of the second row LED lamp varies from 10 degrees to 80 degrees when the first, second optical axes of the LED chips of the first, second row LED lamps are projected onto a cross section of the elongate shell along the direction vertical to the longitudinal direction thereof.

3. The bar-typed double-row LED lighting of claim 1, wherein the bar-typed double-row LED lighting further comprises a first row lens, the first row lens comprises a plurality of lenses and is arranged into lighting direction of the first row LED lamp.

4. The bar-typed double-row LED lighting of claim 3, wherein the bar-typed double-row LED lighting further comprises a second row lens, the second row lens comprises a plurality of lenses and is arranged into lighting direction of the second row LED lamp.

5. The bar-typed double-row LED lighting of claim 4, wherein a distance between any two adjacent lenses of the first row lens is equal to that of the second row lens.

6. The bar-typed double-row LED lighting of claim 5, wherein a minimum distance between any two adjacent lenses of the first row lens is equal to a maximum diameter of a light emitting surface of a lens of the second row lens.

7. The bar-typed double-row LED lighting of claim 5, wherein a minimum distance between any two adjacent lenses of the second row lens is equal to a maximum diameter of a light emitting surface of a lens of the second row lens.

8. The bar-typed double-row LED lighting of claim 1, wherein the first, second depressions are circular arc-shaped grooves which are formed around the optical axis of one LED chip.

9. The bar-typed double-row LED lighting of claim 7, wherein an arc highness of the circular arc-shaped groove of the first, second depressions decreases with decrease of the angle between the first optical axis of the LED chips of the first row LED lamp and the second optical axis of the second row LED lamp along the lighting direction of the bar-typed double-row LED lighting.

10. The bar-typed double-row LED lighting of claim 7, wherein an arc highness of the circular arc-shaped groove of the first, second depressions increase with increase of the angle between the first optical axis of the LED chips of the first row LED lamp and the second optical axis of the second row LED lamp along the lighting direction of the bar-typed double-row LED lighting.

* * * * *